US006709346B1

(12) United States Patent
Wang

(10) Patent No.: US 6,709,346 B1
(45) Date of Patent: Mar. 23, 2004

(54) GRIP SLEEVE FOR GOLF CLUB SHAFT

(76) Inventor: Jack Wang, No. 168-6, Hai Pin Rd., Ching Shui Chen, Taichung Hsien 436 (TW)

( * ) Notice: Subject to any disclaimer, the term of this patent is extended or adjusted under 35 U.S.C. 154(b) by 0 days.

(21) Appl. No.: 10/359,247

(22) Filed: Feb. 6, 2003

(51) Int. Cl.[7] ..... A63B 53/14
(52) U.S. Cl. ..... 473/300
(58) Field of Search ..... 473/300, 301, 473/302, 303

(56) References Cited

U.S. PATENT DOCUMENTS 6,449,803 B1 * 9/2002 McConchie ..... 16/431
2002/0147056 A1 * 10/2002 Sukenik ..... 473/300

* cited by examiner

*Primary Examiner*—Stephen Blau
(74) *Attorney, Agent, or Firm*—Bacon & Thomas, PLLC

(57) ABSTRACT

A golf club grip sleeve includes a sleeve member and an annular skirt member. The sleeve member has a sleeve body and an annular stopper. The sleeve body is provided with an opening at an end thereof The stopper is located at an external periphery of the sleeve body and is extended for a predetermined length from an end beside the opening of the sleeve body towards the other end of the sleeve body. The skirt member is extended outwards from the end beside the opening of the sleeve body and is longer than the stopper so as to be turned back to cover the stopper.

7 Claims, 3 Drawing Sheets

GRIP SLEEVE FOR GOLF CLUB SHAFT

BACKGROUND OF THE INVENTION

1. Field of the Invention

The present invention relates generally to exercise apparatuses, and more particularly to a grip sleeve for a golf club shaft.

2. Description of the Related Art

A regular golf club includes a grip sleeve fitted to a shaft thereof The grip sleeve, which is typically made of rubber, not only is adapted to be a gripping portion of the golf club, but also absorbs counterforce by virtue of the rubber while hitting balls.

Some manufacturers of golf clubs make a grip strap wound around the grip sleeve. The grip strap is substantially made of leather or foam plastic or rubber or compound of the above three materials such that the golf club is provided with preferable gripping and shock-absorption effects and looks preferable in profile.

Referring to FIG. 1, a conventional grip sleeve 10 is formed of a sleeve body 11, an annular stopper 12, and a sleeve cap 13. The sleeve body 11 has a smaller outer diameter respectively than that of the stopper 12 and that of the sleeve cap 13 so as to relatively form a recessed section adapted to be wound around with a grip strap between the stopper 12 and the sleeve cap 13. The grip strap includes an initial end and a distal end. While the grip strap is wound around the grip sleeve 10, the initial end of the grip strap is pressed against the recessed section of the sleeve body 11 and in proximity of the sleeve cap 13 at a bottom side thereof before the grip strap is spirally wound around the recessed section of the sleeve body 11 toward the stopper 12 until the distal end thereof approaches the stopper 12. However, the distal end of the grip strap fails to be retained so as to be turnup by hand's holding. After a period of time, the grip strap will be gradually disengaged from the grip sleeve 10 from the distal end thereof.

Referring to FIG. 2, another conventional grip sleeve 20 is formed of a sleeve body 21 and an annular skirt member 22 extending integrally outwards from an opening of the sleeve body 21. The skirt member 22 can be turned back to cover an external surface of the sleeve body 21, as shown in FIG. 3. Accordingly, while a grip strap is wound around the grip sleeve 20, the skirt member 22 will be turned back to cover a distal end of the grip strap so as to prevent the distal end from exposed outside and to improve the aforementioned drawback of the aforesaid prior art.

However, because the sleeve body 21 is provided with a deficient thickness at the opening thereof, while the grip sleeve 20 is fitted to a golf club shaft, the opening of the sleeve body 21 fails to hold the shaft tight, and thereby the grip sleeve 20 is subject to slip away or disengage from the shaft.

Referring to FIG. 4, still another conventional grip sleeve 30 is formed of a sleeve body 31, an annular stopper 32, and a sleeve cap 33. The sleeve body 31 is provided with a smaller outer diameter respectively than that of the stopper 32 and that of the sleeve cap 33 so as to relatively form a recessed section adapted to be wound around with a grip strap between the stopper 32 and the sleeve cap 33. The stopper 32 is provided with an annular receiving gap 321 for receiving a distal end of the grip strap so as to prevent the distal end from turnup.

Because the receiving gap 321 is so narrow that it's difficult to put the distal end of the grip strap thereinto, it's very inconvenient for a user to widen the gap 321 sweatily to put the distal end of the grip strap into the gap 321. In addition, the gap 321 is so shallow that the distal end of the grip strap fails to be completely received therein, thereby preventing the distal end from turnup ineffectively.

SUMMARY OF THE INVENTION

The primary objective of the present invention is to provide an improved golf club grip sleeve, which preferably covers a distal end of a grip strap wound around the grip sleeve and prevents the distal end of the grip strap from turnup.

The secondary objective of the present invention is to provide an improved golf club grip sleeve, which holds a golf club shaft tight that fitted thereinto.

The foregoing objectives of the present invention are attained by the improved golf club grip sleeve, which is formed of a sleeve member and an annular skirt member. The sleeve member is composed of a sleeve body and an annular stopper. The sleeve body is provided with an opening at an end thereof. The stopper is located at an external periphery of the sleeve body and is extended for a predetermined length from an end beside the opening of the sleeve body towards the other end of the sleeve body. The skirt member is integrally extended outwards from the end beside the opening of the sleeve body and is longer than the stopper so as to be turned back to cover the stopper.

DETAILED DESCRIPTION OF THE INVENTION

Figure 1:
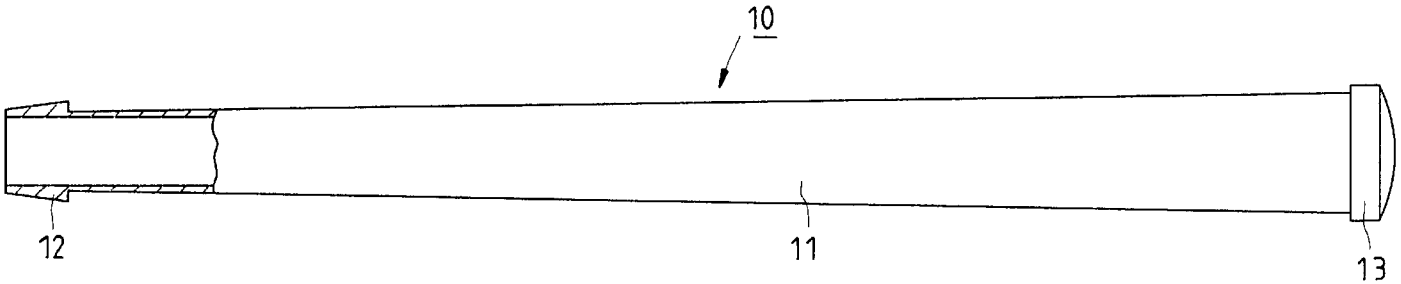
FIG. 1 PRIOR ART
FIG. 1 is a partial sectional view of a first conventional grip sleeve.
Figure 2:
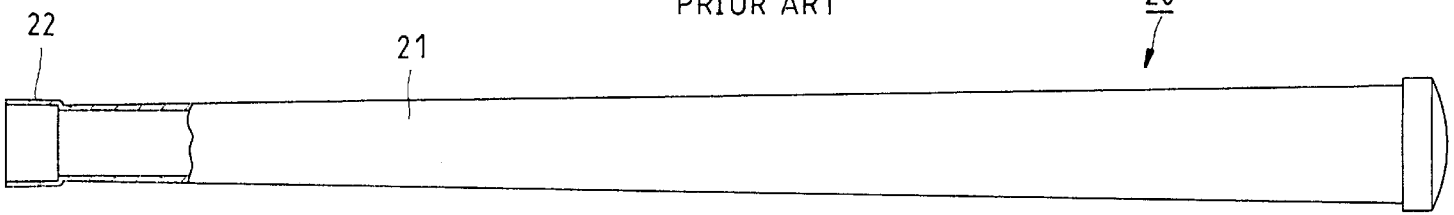
FIG. 2 PRIOR ART
FIG. 2 is a partial sectional view of a second conventional grip sleeve.
Figure 3:
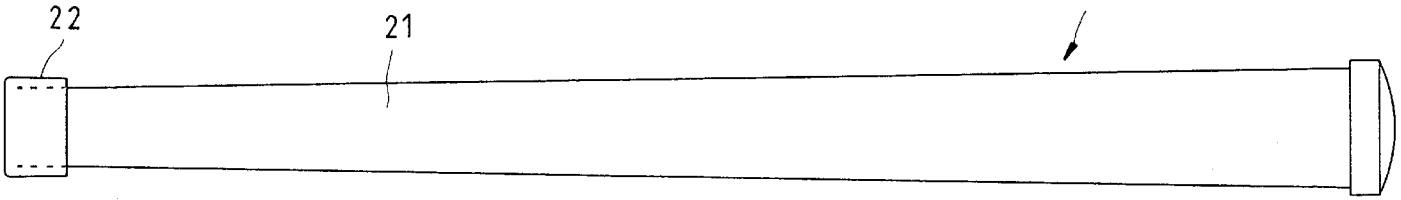
FIG. 3 PRIOR ART
FIG. 3 is a plan view of the second conventional grip showing that the annular skirt member is turned back.
Figure 4:
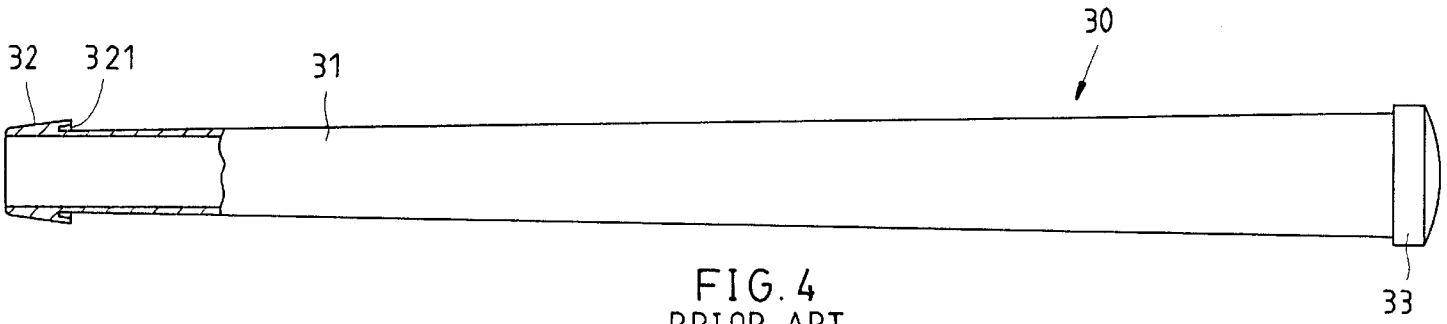
FIG. 4 PRIOR ART
FIG. 4 is a partial sectional view of a third conventional grip sleeve.
Figure 5:
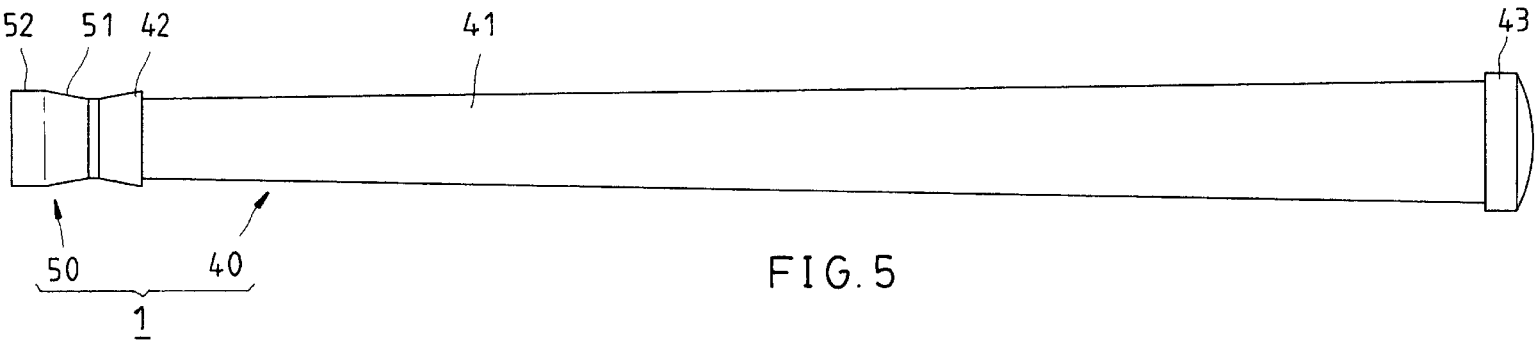
FIG. 5 is a plan view of a preferred embodiment of the present invention.
Figure 6:
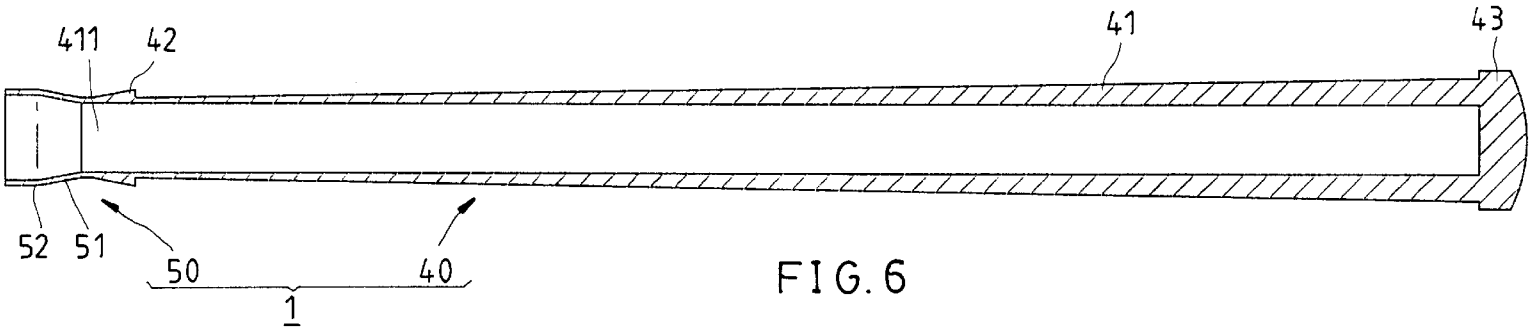
FIG. 6 is a sectional view of the preferred embodiment of the present invention.

Referring to FIGS. 5–6, a grip sleeve 1 of a preferred embodiment of the present invention is integrally made of rubber and is formed of a sleeve member 40 and an annular skirt member 50.

The sleeve member 40 is composed of a sleeve body 41, and an annular stopper 42, and a sleeve cap 43. The sleeve body 41 has an end closed by the sleeve cap 43 and the other end having an opening 411. The stopper 42 is located at an external periphery of the sleeve body 41 and is extended for a predetermined length with an increasing outer diameter from the end beside the opening 411 of the sleeve body 41 toward the sleeve cap 43.

The annular skirt member 50 is composed of a first skirt portion 51 and a second skirt portion 52. The first skirt portion 51 is extended outwards with an increasing outer diameter from the end beside the opening 411 of the sleeve body 41 and has substantially the same length and increasing rate of the outer diameter as those of the stopper 42. The second skirt portion 52 is extended outwards for a predetermined length from a distal end of the first skirt portion 51 with a constant outer diameter.

Figure 7:
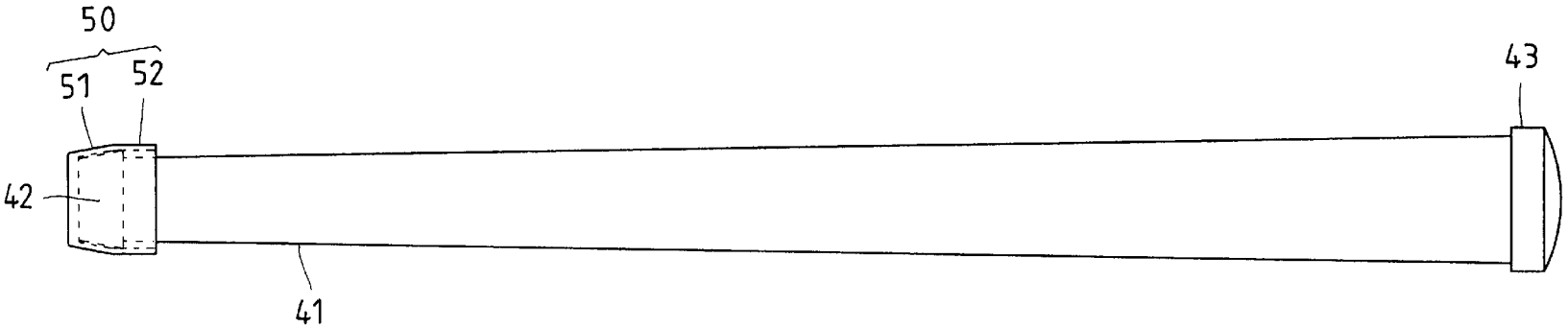
FIG. 7 is a plan view of the preferred embodiment of the present invention showing that the skirt member is turned back to cover the stopper of the present invention.

Referring to FIG. 7, the grip sleeve 1 is made of rubber having excellent resilience such that the skirt member 50 can be turned back and then the first skirt portion 51 covers the stopper 42 and the second skirt portion 52 covers the external periphery of the sleeve body 41 in proximity of the stopper 42.

Figure 8:
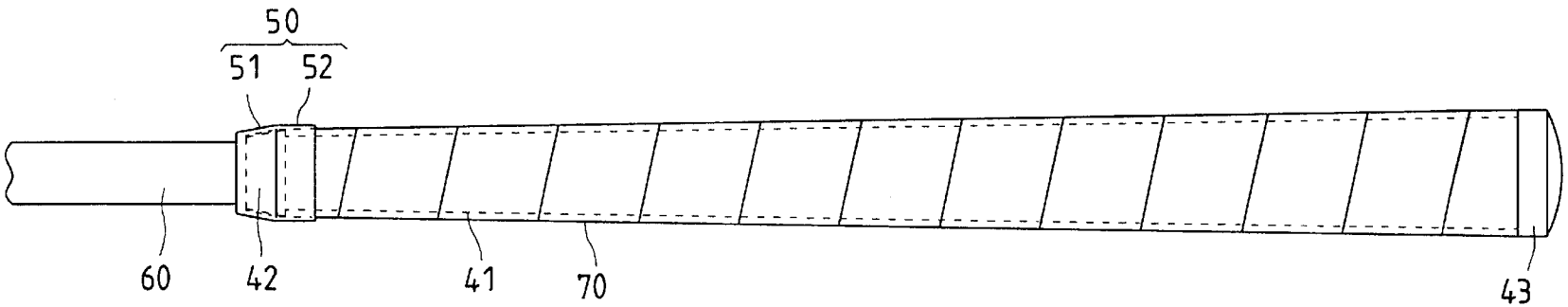
FIG. 8 is a schematic view of the preferred embodiment of the present invention in use.

Referring to FIG. 8, while the grip sleeve 1 is to be wound around with a grip strap, first, keep the skirt member 50 away from the stopper 42 without covering the stopper 42, and then press an initial end of the grip strap 70 to the sleeve body 41 in proximity of the sleeve cap 43 before the grip strap 70 is spirally wound around the external periphery of the sleeve body 41 toward the stopper 42 until a distal end of the grip strap 70 approaches the stopper 42. After the grip strap 70 is completely wound around the sleeve body 41, turn back the skirt member 50 to enable the first skirt portion 51 and the second skirt portion 52 respectively to cover the stopper 42 and to cover the distal end of the grip strap 70. Finally, fit the grip sleeve 1 wound around with the grip strap 70 onto a golf club shaft 60.

The grip sleeve of the preferred embodiment of the present invention includes advantages as follows:

1. Because of having the stopper, the grip sleeve is provided with a preferably great thickness at the opening thereof so as to have a great bond by which the grip sleeve can hold the golf club shaft at the opening thereof, thereby preventing the grip sleeve from slipping away from the shaft.
2. After the grip strap is wound around the grip sleeve, the skirt member of the grip sleeve is turned back to completely cover the distal end of the grip strap at the second skirt portion thereof, thereby effectively preventing the grip strap from disengaged from the grip sleeve.
3. The turnback skirt member strengthens the bond of the grip sleeve such that the grip sleeve holds the golf club shaft tight and is prevented from slipping away from the shaft.
4. Because the outer diameters of the first skirt portion of the skirt member and the stopper are enlarged increasingly at the substantially same increasing rate in directions opposite to each other, while the skirt member is turned back, the first skirt portion and the second skirt portion can respectively smoothly cover the stopper and the distal end of the grip strap wound around the grip sleeve, thereby resulting in excellent covering effect.

What is claimed is:

1. A golf club grip sleeve made of a resilient material, said golf club grip sleeve comprising:

a sleeve member including a sleeve body and a stopper, said sleeve body having an opening at an end, said stopper being located at an external periphery of said sleeve body and extending outwards for a predetermined length from the opening of said sleeve body toward the other end of said sleeve body; and an annular skirt member extending outwards from the opening of said sleeve body and being longer than said stopper so as to be turned back to cover said stopper.

2. The golf club grip sleeve as defined in claim 1, wherein said sleeve member further includes a sleeve cap closing the other end of the said sleeve body and has a larger outer diameter than that of said sleeve body.

3. The golf club grip sleeve as defined in claim 1, wherein said stopper extends for a predetermined length with an increasing outer diameter from the opening of said sleeve body toward the other end of said sleeve body.

4. The golf club grip sleeve as defined in claim 3, wherein said annular skirt member extends outwards with an increasing outer diameter from the opening of said sleeve body.

5. The golf club grip sleeve as defined in claim 4, wherein said annular skirt member has substantially the same increasing rate of the outer diameter as that of said stopper.

6. The golf club grip sleeve as defined in claim 3, wherein said annular skirt member includes a first skirt portion and a second skirt portion, said first skirt portion extending outwards with an increasing outer diameter from the opening of said sleeve body and having substantially the same increasing rate of the outer diameter as that of said stopper, said second skirt portion extending outwards for a predetermined length with a constant outer diameter from a distal end of said first skirt portion.

7. The golf club grip sleeve as defined in claim 1 being made of rubber.

* * * * *